United States Patent [19]

Ray

[11] Patent Number: 4,622,999

[45] Date of Patent: Nov. 18, 1986

[54] GAS FLOW CONTROL SYSTEM WITH PILOT GAS BOOSTER

[76] Inventor: William A. Ray, 888 S. Orange Grove Blvd., #3E, Pasadena, Calif. 91105

[21] Appl. No.: 745,792

[22] Filed: Jun. 17, 1985

Related U.S. Application Data

[63] Continuation-in-part of Ser. No. 481,075, Mar. 31, 1983, abandoned.

[51] Int. Cl.[4] ..... F16K 31/128

[52] U.S. Cl. ..... 137/599; 137/492.5; 137/613; 137/885; 431/89; 251/29

[58] Field of Search ..... 137/492, 492.5, 613, 137/881, 882, 885, 599, 487.5, 488, 495, 110; 431/62, 89; 60/405; 91/28; 251/29, 30.1

[56] References Cited

U.S. PATENT DOCUMENTS

| | | | |
|---|---|---|---|
| 1,090,866 | 3/1914 | Floyd | 251/29 X |
| 2,278,952 | 4/1942 | Soderberg | 137/492.5 |
| 2,361,632 | 10/1944 | Jones | 137/637 X |
| 2,362,631 | 11/1944 | Harris | 137/492.5 X |
| 2,450,833 | 10/1948 | Lee | 137/110 X |
| 2,763,280 | 9/1956 | Sonyder | 137/492 X |
| 2,878,832 | 3/1959 | Hoge | 137/596.16 |
| 2,909,193 | 10/1959 | Hoge | 137/596.16 |
| 2,912,696 | 11/1959 | Roudanez | 431/18 X |
| 3,135,281 | 6/1964 | Morgan | 137/110 |
| 3,286,636 | 11/1966 | Schaub | 137/110 X |
| 3,463,182 | 8/1969 | Evans et al. | 137/494 |
| 3,593,736 | 7/1971 | White | 137/110 |
| 3,618,383 | 11/1971 | Holben | 137/110 X |
| 3,888,603 | 6/1975 | Nagase | 417/44 X |
| 3,975,115 | 8/1976 | Fisher et al. | 417/44 X |

FOREIGN PATENT DOCUMENTS

| | | | |
|---|---|---|---|
| 2723178 | 12/1977 | Fed. Rep. of Germany | 431/89 |
| 116667 | 9/1926 | Switzerland | 137/110 |
| 2044432 | 10/1980 | United Kingdom | 137/599 |

*Primary Examiner*—A. Michael Chambers
*Assistant Examiner*—John C. Fox
*Attorney, Agent, or Firm*—Evanns & Walsh

[57] ABSTRACT

A control arrangement for a gas-fired system. Three diaphragm-operated valves are in series providing a stage operation. The valves are pilot controlled. A booster pump is provided for cooperation with the pilot valves to boost the line pressure to the first of the valves, the boosted pressure being sufficient to operate the diaphragm valves, and the boosted pressure being controlled by the pilot valves. The booster pump operates only when needed. Diaphragm-operated pilot valves means are provided which operate two separate pilot valves which control the pressure on the opposite sides of the diaphragm of the diaphragm valves. The system provides stage operation, the stages including a first stage which is closing of a vent valve connected between diaphragm control valves, opening of a first diaphragm valve, and a third stage which is a controlled slow opening of the second diaphragm control valve. The first diaphragm valve is both a control valve and a pressure regulator.

16 Claims, 10 Drawing Figures

GAS FLOW CONTROL SYSTEM WITH PILOT GAS BOOSTER

This is a continuation-in-part filed on Mar. 31, 1983, now abandoned.

BACKGROUND OF THE INVENTION

1. Field of the Invention

The field of the invention is that of controls for flow of gas in gas fired heating systems. The invention is particularly concerned with the pilot control of the main gas valves and all of the other control components by using a boosted gas pressure as the motive fluid.

2. Description of the Prior Art

Control valves and gas fired systems originally were electro-mechanical until another generation of control valves developed which were of an electro-hydraulic type, one of them having been known as the Hydramotor and also one known as Fluid Power Unit. This unit used a different motive fluid embodying hermetric pump and metal bellows.

It appears that the electro-hydraulic unit generally dominates the market world wide currently except for some large direct solid/magnetic units in Europe which are bulky, and large users of energy. They are inherently quick acting and have an inability to move slowly for modulating purposes and are otherwise deficient.

The prior art systems are expensive, heavier, and considered less adaptable than is desirable. They are deficient as respects all of the advantages set forth hereinafter possessed by the subject invention.

SUMMARY OF THE INVENTION

The system includes a main diaphragm operated control valve which is also a pressure regulator; a second similar valve which is a diaphragm operated shut off valve and a third diaphragm valve which is in a vent line connected to the line between the other two valves and which is normally closed during operation.

A feature of primary significance of the invention is that all of the valves referred to which are diaphragm operated, are under pilot control by means of a pilot valve; the motive fluid for operating the valves being the gas itself which the system controls. A booster pump is provided which draws on the incoming gas itself and boosts its pressure sufficiently so that its discharge pressure can be used for operation of the valves referred to as well as all of the other components of the system. The motive fluid is not limited to gas.

The system includes control means for shutting off the booster pump at a predetermined pressure developed by the pump. The shut off means includes a Triac which operates as a relay. It is controlled by a pilot mechanism which includes a reed switch controlled by a diaphragm actuated mechanism.

A main pilot valve is provided in association with valves operated electrically and a further diaphragm type pilot valve which controls the main shut off valve. Additionally, pressure operated diaphragm switch actuators are provided for purpose of shutting off flow at minimum and maximum flow values.

A main diaphragm operated pilot valve mechanism is provided, which in association with the other control valves automatically in response to pressure produces a staging operation, that is, a first closure of the diaphragm valve in the vent line; then opening of the first valve which also operates as a pressure regulator; and then a slower opening of the other main valve which is a shut off valve.

The invention avoids or eliminates the draw backs and deficiencies of prior art systems as identified in the foregoing and acheives its primary objects as well as realizing a large number of advantages over existing systems.

A primary object of the invention is to realize a gas flow control system using diaphragm valves and components controlled by a pilot valve mechanism whereby the pilot motive fluid is the incoming gas itself which has been raised in pressure by a booster pump to a desired operating value.

Another object is to provide a system wherein the number of valves is reduced, the system being more reliable and at the same time more economical.

A further object is to realize in a system of the type described an automatic staging operation responsive to the said boosted pilot gas pressure wherein the staging operation includes firstly the automatic closing of a vent valve; the opening of a control and pressure regulating valve as a second stage; and as a third stage or more gradual opening of a further control valve.

The nature of the system as identified in the foregoing is such that a number of other very significant advantages are realized.

The system will accommodate the use of the gas pressure supplies even though supplies may be as low as 4" of water pressure or even zero pressure, that is, the same as atmospheric or medium to high pressure, that is, up to 5 to 15 pounds per square inch and higher. Typically externally actuated valves need increasingly larger operators and energy input as pressures go up. The herein gas control system uses the same size actuator but yet provides high valve seating force and necessary damper operating forces with a common actuator drawing uniform operating power. Achieving these results constitute objects of the invention.

Another advantage of the invention is that no oil or other external fluids or sources are used and there are no mechanical actuators. The gas line itself is always available and does not result in operation and service replacement due to the system having the characteristics of very minor acceptable fluid medium leakage. There is no need for buying oil as a motive power medium.

Another object of the invention is to realize the advantage that there are no viscosity problems or freezing problems so the system is accommodated to a wide ambient temperature in the range of operation from −40° F. and even lower to 200° F. or 300° F. or even higher.

Another advantage is that the operation timing is much more stable and invariable.

There is no oil to leak or give rise to spot and the system has less weight. Another advantage is that the system makes practical use of only a pressure source that can be easily conduited from the said source to areas where needed.

Another advantage is that the single fluid pressure source reduces costs substantially as well as components and uses of electrical energy making operation from 24 volt control lines easier and more practical. A further advantage is that the pressure booster pump acting on gas can accumulate and transfer as well as generate more working force more efficiently than pumping oil as a working fluid.

Another advantage is that the booster pump can operate on line pressure all the way from zero pressure, that is atmospheric, to 60 to 90 pounds per square inch or higher thus obviating the need for increasing actuator sizes with increasing gas pressure as necessary on known current external actuators. In other words, the system is more highly adaptable by a considerable margin.

Another advantage is that the operating medium being the gas itself never needs replacement due to leakage or aging, but is always fresh from the gas line.

Another advantage is that by use of the compressible fluid medium, that is, the gas permits the use of fixed positive and inexpensive stops and reduces operating limit switches to one which controls the pump motor as well as reducing the pump pressure sources to a single one.

Another object that is realized is that the said system automatically insures a proper sequencing, that is, programming of the valves which avoids gas waste and insures providing adequate regulated gas pressure and safe system operation.

Another advantage is that the proper sequencing and staging can readily be achieved using the gas as a motive fluid by adjusting sizes of closing springs.

Another advantage that is realized is that if fast main burner start up is required or fast combustion programming or additional safety these purposes can readily be realized.

Another advantage is that testing for tight valving can be very simply and readily accomplished.

Further objects and advantages of the invention will become apparent from the following detailed description and annexed drawings.

DESCRIPTION OF A PREFERRED EMBODIMENT AND BEST MODE OF PRACTICE OF THE INVENTION

Figure 1:
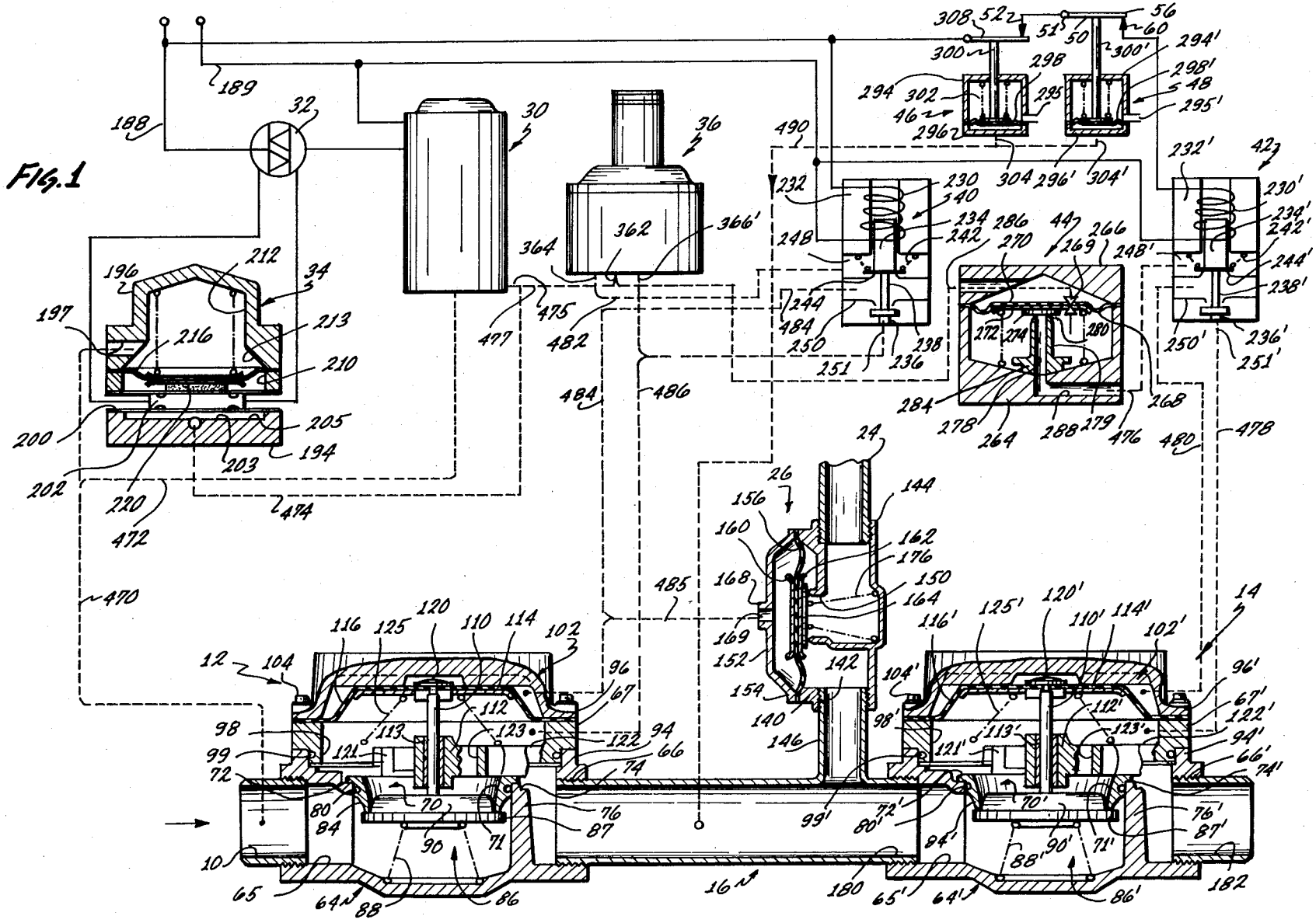
FIG. 1 illustrates partially diagramatically the complete control system.

FIG. 1 illustrates the complete system, the electrical connections being shown in full lines and the control gas flow lines being illustrated for simplification by way of broken lines.

The main components of the system will be first identified. Then each component will be described in detail after which the control gas flow circuits will be described as well as the overall operation of the systems.

Referring to FIG. 1 numeral 10 indicates the entering gas flow line. The entering gas may be at a pressure of atmospheric to 60–90 pounds per square inch. Numeral 12 designates a main valve which is a control valve and gas pressure regulator. Numeral 14 designates a second valve which is a control and shut off valve which is very similar to the valve 12. Numeral 16 designates the gas flow line between the valves 12 and 14 and numeral 20 designates the discharge gas line from the valve 14. Numeral 24 designates a gas line which is connected to the line 16 between the two valves, the line 24 leading to a vent. In the line 24 is a valve 26 which, as will be pointed out, is normally closed during operation.

Having reference to the control instrumentalities, that is, the pilot valves and other controls it is pointed out that a principal and significant feature of the invention is that the gas entering line 10 itself is used as the motive power fluid for actuating the control valves. This is accomplished by way of increasing the pressure of this gas to a value sufficient to accomplish the control purposes by means of a booster pump as designated by the numeral 30. As shown, this is an electrically driven pump and it may be of known commercial type or otherwise.

Numeral 32 designates a control element for the motor of the pump 30, the element 32 being a Triac which can be gated between on and off positions.

Numeral 34 is a gas operated reed switching device which acts as a pilot or control device for the Triac 32 which serves a function similar to that of a relay.

Numeral 36 designates the main pilot valve mechanism which is shown in detail in FIGS. 2 through 5, which will be described in detail presently.

Numeral 40 designates an electrically operated three way pilot valve.

Numeral 42 is another electrically operated three way pilot valve which is like the valve 40.

Numeral 44 is a constant flow pressure regulator pilot valve which exercises control over the valve 14 as will be described.

Numeral 46 is a diaphragm operated electrial switching device.

Numeral 48 is a diaphragm operated switching device like the device 46. The gas operated devices 46 and 48 operate a switching mechanism which has a lever 50 that operates about a pivot 51. At one end of the lever is a stationery contact 52 which cooperates with a contact 54 which cooperates with a contact 54. The opposite end of the lever member 50 forms a contact 56 that cooperates with a fixed contact 60. This diaphragm operated switching mechanism with the contacts operates as a minimum pressure control and a maximum pressure control as will be described.

Description of Components

Referring to the control valve 12 it has a body 64 having inlet channel 65 and an outlet channel 66 connected to the tube or pipe 16. Numeral 67 is a ring on body 64 forming a bonnet base.

Within the valve is a seat member or ring 70 having a base 71. This ring has a flange 72 which seats on valve orifice 74 formed in an upper part of the valve body and including cylindrical member 76 having in it the opening for the inlet channel 65. The valve ring 70 has an annular groove in it below the flange 72 having in it a sealing O-ring 80 which seals agains the inside surfaces of the valve orifice 74 as described.

At the lower part of the valve ring 70 is the seat the lower edge of which is tapered as shown at 84 for cooperation with the moveable valve member itself. The valve member is designated by the numeral 86. It has a cylindrical part 87 which seats against the seat formed by the member 84, the upper part of the valve member 86 being the circular part which is positioned inside of the seat member 84 as shown. Valve 87 is biased upwardly by tapered coil springs 88 and 125.

At the upper part of the valve body is a cylindrical flange 94 which receives the valve bonnet base 67. The bonnet base 67 has a lower part 98 that seats within the flange 94 and is sealed to it by a sealing O-ring 99 that seats against the inside surface of flange 94.

The valve has an upper bonnet part 102 having an extending flange 96. This part is secured to the valve body by a circle of bolts as designated at 104.

Numeral 110 designates a valve stem connected to the valve member 86. The stem extends through a bushing within which is a sleeve 113 made of a material to provide for a friction free sliding movement.

At the upper end of the stem 110 is a diaphragm plate or disc 114 above which is a flexible diaphragm 116. The diaphragm 116 and the disc 114 are secured to the end of the stem 110 by way of a stem and securement member 120 as may be seen.

The bushing 112 is part of a casting member 121 that is within the bonnet ring which includes a spider 127 having three radially extending members, one of which is designated 122. Between this member and the disc 114 is a tapered coil spring 125. From the foregoing it can be seen that a gas chamber is provided in the bonnet and bonnet base above the diaphragm 116. The chamber below the bonnet communicates with the valve outlet 66 around the member 76. The radial arm 122 is shown in cross section at 123. The ring 70 is retained by member 121 and spider 127 which is part of bonnet base 67.

Referring to the valve 26 as previously pointed out it is in the line 24. It includes a valve body 140 having an inlet 142 and an outlet 144. The inlet 142 is connected to the pipe 16 by a tube or a pipe 146.

Within the valve body 140 is a ring shaped seat member 150. Attached to the valve body 140 is a bonnet 152 having a flange 154 which is secured to the upper part of the valve body 140 with the edges of a diaphragm 156 held between these surfaces. Attached to the center part of the diaphragm is a disc member 160 on one side and a disc member 162 on the other side carrying the circular valve member 164 which can seat on the valve seat 150. The bonnet member 152 has an extending nipple 168 having an orifice 169 for delivery of control gas to the diaphragm chamber between the bonnet and the diaphragm member. Numeral 176 designates a tapered spring member one end of which acts on the valve member 164 and the other end which seats against the valve body as shown.

Referring to the valve 14 it has the same construction as the valve 12. It has an inlet 180 to which the tube or pipe 16 is connected and an outlet 182 connecting to the discharge line. The parts are identified by the same numerals primed as valve 12.

The valve 14 has a diaphragm chamber as shown above the diaphragm 116' and there is a gas chamber below the diaphragm 116' which is in communication with the outlet 182. The control gas can be admitted to both of these chambers as will be described.

As previously pointed out the valves 12, 14 and 26 are controlled by pilot gas as will be described presently.

The control gas is taken from the gas line 10 itself. Gas from this line is boosted in pressure by the booster pressure unit designated by the numeral 30. This unit can increase pressure to 6 pounds per square inch which, as will be explained, is sufficient for operation of all of the diaphragm operated valves and devices. The unit 30 is supplied with power from an electrical source through wires 188 and 189 as shown.

In one of the leads is the relay provided by the Triac 32 which is of a conventional type and which is controlled by the gas controlled pilot device 34 which will be described.

The pilot device 34 has a body 194 over which is secured a bonnet 196. The body 194 has a transverse cylindrical or tubular channel 200 through it. Within this channel is a glass enclosed reed switch 202.

Numeral 203 designates a recess in the body 194.

The body 194 has a bore 210 in it. The bonnet 196 has a bore 212 and a tapered counter bore 213. Numeral 216 designates a diaphragm the peripheral edges of which are sealed between the bottom edge of the bonnet 196 and the top of the body 194. The diaphragm 216 carries a permanent magnet 220 which is in a position proximate to the reed switch 202 so that the reed switch can be operated by pressure within the body 196 acting the diaphragm 216. The pressure when increased by the booster unit as will be explained can be let in to act on the diaphragm 216 so as to move the magnet 220 so as to operate the reed 202 to provide a signal for gating Triac 32 so as to turn it off and to turn off the unit 30. The unit 30 as will be explained does not operate continuously but is turned off when booster control pressure is not needed. Switch 202 is normally closed and opens in response to pressure to gate Triac 32 to open the circuit to booster 30.

The main pilot control unit 36 as previously pointed out is shown in detail in FIGS. 2 and 6 and this unit will be described in detail presently.

The three way valves 40 and 42 are alike so that both need not be described. The three way valve 40 has an electric winding 230 which is connected across the line 188–189. It has a core 232 and a plunger 234 connected to a valve member 236 by way of a stem 238 which cooperates with a valve seat 240. Numeral 242 designates a tapered coil spring which normally acts on the plunger 234.

The valve 40 has an upper seat 244 which can be engaged by the end of plunger 234 which forms a valve. The valve 40 has an inlet as designated at 248 and connections 250 and an outlet connection as designated at 251.

As pointed out the valve 42 is like the valve 40.

The winding 230 of valve 40 normally connected across the line 188–189 and winding 230' is connected through the switch formed by the contacts 56–60.

The unit 44 is a pilot valve for the valve 14 which provides for a constant volume flow of control gas through the three way valve 42 to the valve 14 as will be described in detail presently. The unit 44 has a body 264 and a bonnet 266 with a diaphragm 268 having its edges sealed between the body and the bonnet. On one side of the diaphragm 268 is a diaphragm 270 and on the opposite side is a disc 272 which carries valve 274. Numeral 279 designates a central stem having a channel or bore 278 in it, the upper edge of which forms a seat 280 for the valve member 274. The stem 278 is secured to the bottom of channel within the valve body by cylindrical member 284. The valve 44 has an inlet as designated at 286 and an outlet as designated at 288 which connects to the three way valve 42.

As previously pointed out the switching units 46 and 48 are essentially alike. Referring to the unit 46 it has the body part 294 to which is attached the end cap or bonnet 296 and the element 298 is a diaphragm having its edges secured between the body 294 and the end cap 296. The diaphragm carries a stem 300. The diaphragm and stem are normally biased downwardly by a coil spring 302. The gas can be admitted into the chamber below the diaphragm by way of channel 304. Body part 294 has a vent 295.

The stem 300 acts on a switch member 308 that cooperates with the contact 52.

The unit 48 has a switch actuating stem 300' which acts on a pivoted contacting member 50 as previously described so as to control the winding 230' of the three way valve 42, by way of contacts 56–60.

Unit 46 is normally open and 48 is normally closed.

Pilot Valve 36

As previously pointed out this unit is shown in detail in FIGS. 2 through 10. As may be seen in these figures this unit has a body 320 and a bonnet or cap 322. The cap 322 is secured to the body 320 by bolts as indicated at 324. The cap 322 has a central cylindrical boss 330 at the top which has a bore 332.

Numeral 336 designates a screw cap which is threaded into the upper end of the bore 332. Numeral 337 designates an atmospheric air vent from bonnet 322.

Numeral 340 designates a flexible diaphragm the peripheral edges of which are secured in sealing relationship between the top edges of the body 320 and the peripheral edges of the cap 322. On one side of the diaphragm 340 is a disc 342 and spring 341 on the opposite side is disc 344. The discs and the diaphragm 340 are secured together by bolts one of which is designated at 350. The bolts serve as a stop to limit upward movement of the diaphrapm.

The body 320 has a bore or space 354. The interior of the body provides a control chamber for control gas acting on the diaphragm 340. At one side of the bore 354 formed integrally with the body 320 is a structure 358 which has provided in it gas control channels and a pair of pilot valves. This particular structure is shown in cross section in FIG. 2 and also in FIGS. 3–10.

Figure 6:
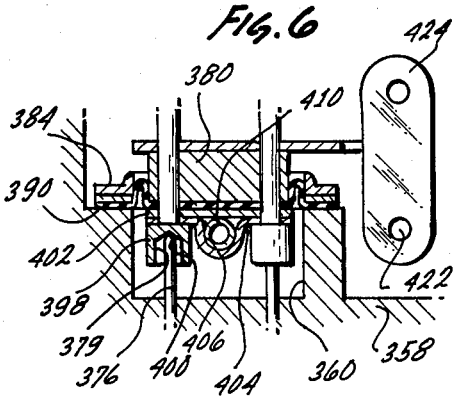
FIG. 6 is a sectional view of the form of actuator for the pilot valves of FIG. 2.

Within the structure or part 358 is a chamber identified by the numeral 360 which also may be seen in FIG. 6. This chamber communicates with a vertical bore 364 which extends to the bottom 363 of the body 320.

The two pilot valves are provided in the bores 362 and 366 in the body 320. In the bore 366 is a seat member 372 having a bore 371. At the bottom of the bore is a partly spherical valve seat 372, the ball valve having a stem 376. Bore 366 communicates with the space or chamber 354 through channel 367.

The numeral 375 designates a coil spring which acts on on the ball 374. The bottom of the spring is held by a washer 377, the washer having a center opening 378. In the bore 362 is another ball valve 374' having a stem 376'. The two valves and the associated structure are exactly alike so the second one need not be described in detail. The two ball valves are operated by a tilting movement occasioned by movement of the diaphragm 340 and its associated subassembly.

Figure 7:
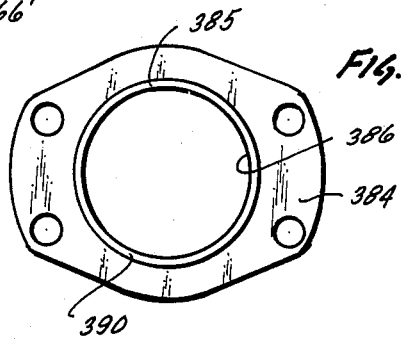
FIGS. 7 and 8 show details of the diaphragm pilot valve structure.
Figure 8:
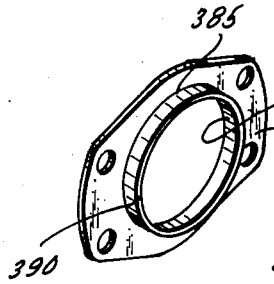
Figure 4:
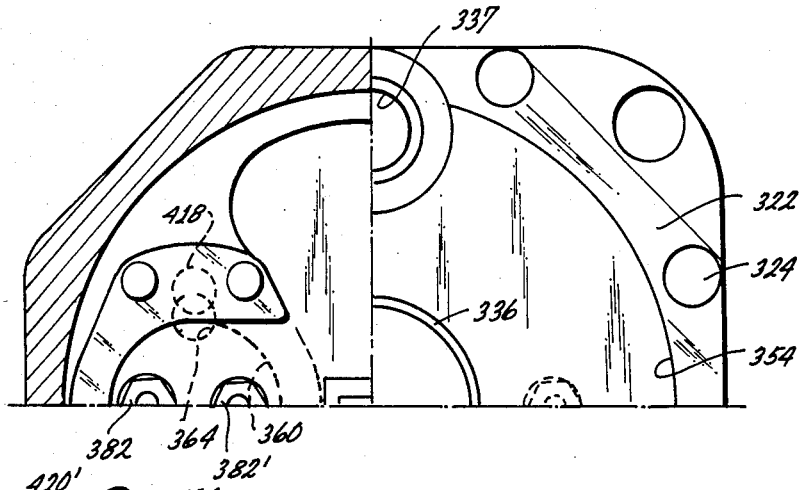
FIG. 4 is a half sectional view of the control valve of FIG. 2, and a half view of the top of the valve.

The two valves are operated by a round block member 380 through which both stems 376 extend, there being nuts 382 and 382' threaded onto the ends of bots. Numeral 384 designates a plate member which is over the circular opening 360 in the upper part of the integral portion 358. The shape of plate member 384 is shown in FIGS. 7 and 8. This member has an upstanding flange 385 having a bore 386 which has a larger diameter than the part 380. The part 380 has bores 379 and 379' extending through it through which extends the stems of the bolts 381 and 381'. Positioned between the flange of the part 384 and the surfaces around the bore 360 are the edges of a flexible diaphragm 390. These parts being in sealing relationship with a circular portion of the diaphragm 390 having a fold 391 in it so as to extend upwardly between the part 384 and the outside surface of the member 380. The fold 391 in the diaphragm is circular in shape as may be seen in FIG. 8. The plate 384 has holes in it as shown for securing it to body 320. The stem 381 of the bolt 382 has a circular fitting member at its end identified by the numeral 398, this part having a bore 399 the upper end of which is conical as shown at 400. See FIG. 6. The upper end of the stem 376 engages the conical part 400 of the bore. This relationship of the parts allows for tilting movement of the member 380 and the opening and closing of the two pilot valves. Please refer to FIG. 6.

Referring again to the figures, numeral 402 designates a flat member which fits against the bottom of part 380 with the diaphragm 390 between these parts the bolt stems 381 and 381' extending through the member.

Numeral 404 designates a second plate member which is adjacent to the plate 402 and which has a semicylindrical central part 406 which provides a journal for a pivot stem 410. See FIGS. 2 and 6. As previoulsy explained the two pilot valves are exactly alike so that the second one need not be described in detail. As will be explained the part 380 can be tilted in response to movements to the diaphragm 340 and its associated discs to operate the stem of the two pilot valves, this action being permitted by reason of the engagement of the stems with the conical bores in the parts 398 and 398'.

Figure 3:
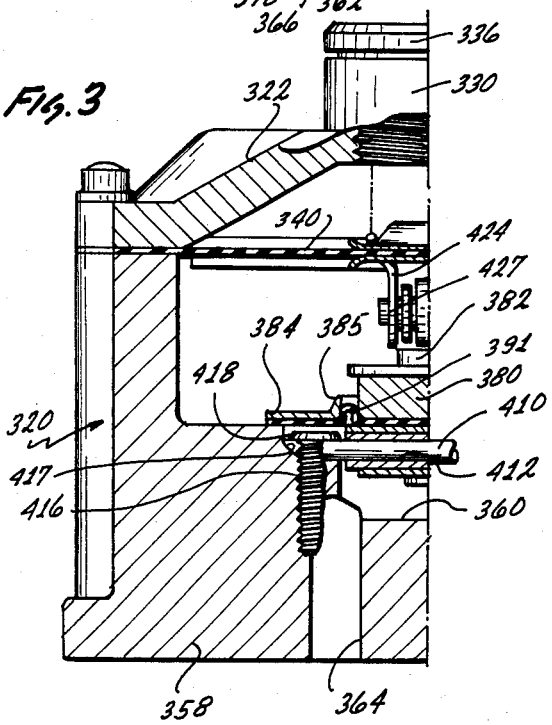
FIG. 3 is a sectional view of the control valve of FIG. 2.

The stem 410 extends through a horizontal tube 412 and rests in a groove formed in the portion 358 and retained by screw 418 as my be seen in FIG. 3. The chamber 360 in the portion 358 communicates with the bore 364 as previously described. The end of the stem 410 engages a retaining screw 416 as may be seen in FIG. 3 having a head 418 in a depression, which is underneath the cap member 384 as may be seen in FIG. 3.

The screw 416 holds the end of the shaft 410 which as previously explained is held in the deformations of the saddle 406 in plate 384.

The half section shown in FIG. 3 shows the screw holding one end of the shaft and there is a similar screw at the other end to hold the other end of the shaft, (not shown).

The head of the screw is underneath part of the diaphragm 390 as previously described and a part of the plate member 384 is over the diaphragm and over the head of the screw so as to seal with respect to gas.

Attached to the underside of the disc 344, previously described, is a member 424. Numeral 419 is a yoke having two downwardly extending yoke arms 420 and 420' in FIGS. 9 and 10. Extending between the arms of the yoke is a pivot shaft 422. Yoke 419 carries link 428. As shown in FIG. 6 the assembly of yoke 419 and part 380 is mounted to pivot around shaft 410.

Thus, it can be seen as the diaphragm 340 and its associated discs move up or down, through the lever actuating mechanism, as just described, wlll operate to tilt the member 380 around pivot stem 410 whereby to actuate the stems for the two ball valves 374 and 374' as will be described more in detail presently.

The member 380 can be tilted to a maximum of 9°, the working range being 6°. There is a zero or null position wherein both of the pilot waves are closed as will be described presently.

Referring to FIG. 1, numeral 470 designates a gas line leading from the inlet gas line 10. It extends to a port 197 in the side of the upper part 196 of the unit 34, that is, the chamber above diaphragm 216. Numeral 472 designates a branch from the line 470 that leads to the inlet of the pressure booster unit 30. Numeral 474 is a line from the discharge side of the booster unit which leads to the chamber in unit 34 underneath the diaphragm 216. At pressure of, for example, 6 pounds above line pressure in line 470 in the discharge line 474 the diaphragm 216 is lifted moving the magnet 220 away from the reed switch 202 to position it to gate the Triac 32 which acting as a relay will turn off the booster pump.

Numeral 475 also designates a discharge control line from the unit 30 which has a branch 477 to the port 362 of the pilot valve 36. It continues to the unit 44 to convey gas over the diaphragm 268 of that unit. The diaphragm 268 has an adjustable orifice 269 in it which allows for a bleed of gas through the diaphragm so that the valve of the unit 44 provides a steady controlled pressure, that is, a constant flow for purposes as will be described of allowing the valve 14 to open slowly. Numeral 476 designates the gas line from the outlet of unit 44 to the inlet 242 of the three way valve 42.

Numeral 478 designates a gas control line from outlet of three way valve 42 to the chamber underneath the diaphragm 116' of the valve 14. This chamber is in communication with the outlet of this valve.

The numeral 480 designates a gas control line from the chamber 244' of three way valve 42 to the chamber of valve 14 over the diaphragm 116' by means of which a pressure is established for opening valve 14.

Referring to the pilot valve 36, the ports 362, 364 and 366' are identified in FIGS. 1, 2, 3, and 5.

The line 475 connects to port 362 which leads to the valve on the right, that is 374', which is open because at this time there is no pressure on the diaphragm 340 so the spring opens the valve.

The gas can now flow out of the pilot valve 36 through chambers 360, port 364 and the line 482 to an inlet to three way valve 40 and through line 484 out of this three way valve and into the chamber over diaphragm 116 in valve 12. Line 485 is a branch line which connects to the chamber over the diaphragm 156 in the valve 26 so that this valve closes and this happens before valve 12 opens.

Gas from the chamber below the diaphragm of valve 12 passes outwardly or is released through the line 486 and through port 366' of unit 36.

The valve referred to in unit 40 is open because the power has now been turned on.

As can be seen a stage operation has occurred in that valve no. 26 closes before no. 12 opens. The pressure in the pipe 16 now continues to build, valve 26 leading to the vent now being closed. It requires, for example, 1 pound per square inch, for example to open valve 12. Valve 26 must be kept closed. It operates at a pressure valve less than the minimum pressure for opening valve 12.

Valve 26 is in a safety vent leading to the roof of the building, so, of course, it has to be kept closed while gas is going through valve 12. The booster unit 30 will run until it builds up to 6 pounds per square inch pressure. As the pressure builds up in the outlet of valve 12 pressure now is lead to the unit 36 through the line 486. The pressure is lead into the chamber underneath the diaphragm 340 of the unit 36. When the pressure on the diaphragm comes over the spring acting on it, the pilot valve on the right, no. 374', closes cutting off any more flow to the chamber over the diaphragm 116 in valve 12. When the pressure in the discharge line 16 builds up sufficiently this pressure in the unit 36 can balance the spring force and when it does, it closes the valve 374' on the right and opens the one on the left, 374, if necessary.

The balancing of valve 12 comes about by relieving the pressure on top of the diaphragm 116 which goes backward through the three-way valve 40 which is still open and which then goes back through line 482 and port 364 to chamber 360 of unit 36 which is the common of the three way valve.

The left valve 374 of unit 36 is now open allowing the pressure to go out through it and through channel 367. See the detailed description of operation hereinafter.

The valve 12 is a pressure regulator. The unit 36 is the pilot regulator for valve 12.

The booster unit is operating at this time and its outlet pressure starts building up above 3 pounds. The unit 44 now gets pressure directly from line 475 above its diaphragm 268 and the pressure bleeds through the diaphragm by way of orifice 269 at a constant rate so that this valve opens allowing a steady constant volume of flow through it and through the line 476 to the three way valve 42. This pressure is taken through the line 480 to the chamber above the diaphragm 116' in valve 14 so that the staging operation includes first the closure of valve no. 26; the opening of valve 12; and then the opening of valve 14. The orifice 269 in the unit 44 causes a slow controlled opening of valve 14. The orifice produces a constant flow through the valve of unit 44. By maintaining a constant pressure across the orifice 269 this maintains a constant flow.

The reason for unit 44 is to cause valve no. 14 to open slowly because the boiler cannot take a sudden or fast flow of gas right at the start, since this would cause the boiler to "gag" on the flow. Valve 14 is arranged to open in, for example, from 6 to 30 seconds. At the outset of operation there is a cold chimney and no draft so that these components would not be able to handle all the products of combustion when everything is cold, thereby offering resistance to the beginning of a normal operation.

The valve 14 requires an approximate timing for opening; the opening rate is not necessarily critical but is a matter of consideration. It might be said that the timing is critical, but not supercritical.

The unit 46 is a minimum pressure switch such that upon pressure dropping below a minimum value as measured through line 490 which connects to the pipe 16 between valves 12 and 14, the contacts 52–54 will open causing shutdown. Unit 48 is a maximum pressure switch whereby upon a maximum and undesirable pressure being reached in line 16 and hence 490, contacts 56 and 60 will open and shut down the unit or prevent opening of valve 14.

The boiler system cannot be started at less than 30% of full fire. This is the trade standard although some burners are better than others. If the flow gets up to 110% or 120%, unit 48 will open its contacts deenergizing the three-way valve 42 and shutting down the system.

In both valve 12 and 14, the chamber underneath the diaphragm is in communication with the discharge side of the valve. If pressure above the diaphragm in each case is relieved thereto, that valve closes.

Figure 2:
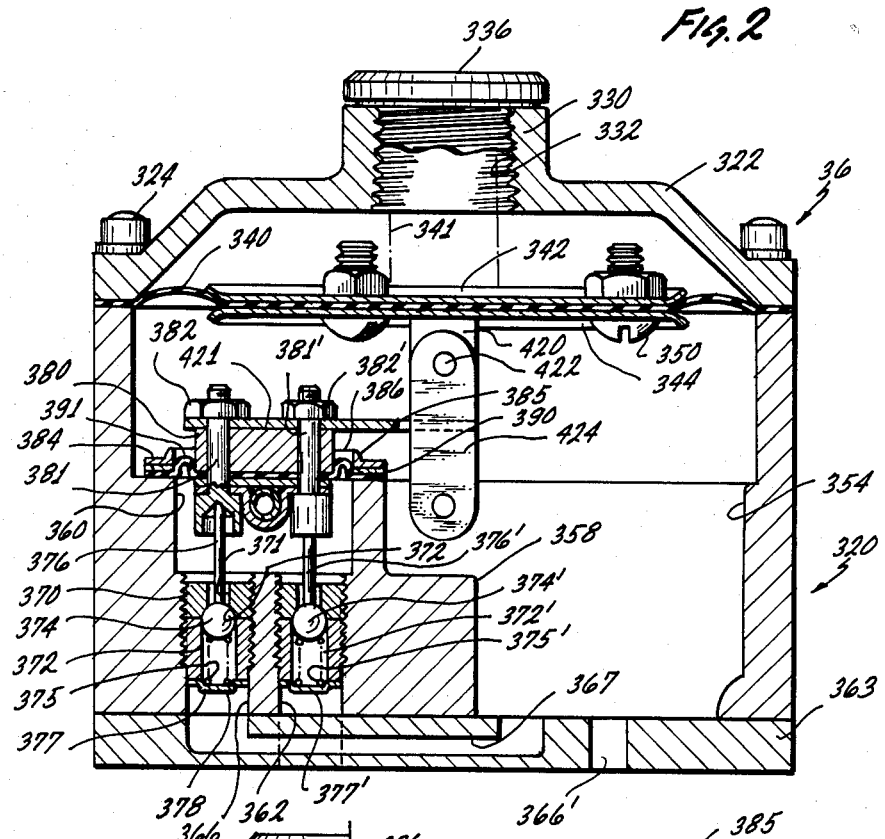
FIG. 2 is a cross sectional view of the main pilot control valve.

Referring to the two pilot valves 374 and 374' in FIG. 2, these valves open to the common chamber 360, and the common chamber connects to the bore 364 in FIG. 3.

It is pointed out that in the neutral position of the two pilot valves 374 and 374' of FIG. 2, both of these valves are closed. In the zero or null position indicated on the drawings, they are both closed. When these valves are in the neutral position, nothing is going on and valve 12 is not moving in either direction, that is, the valve member 87 of valve 12 stays in its position.

As pointed out in the foregoing, whenever the pressure in the discharge of the unit 30 gets up to 6 pounds per square inch, the Triac 32 shuts the booster unit off. It might stay stopped for 30 seconds, or on the other hand, it might be inoperative for as long as 3 hours, by way of example, if operation is stable.

The valve 12 performs functions which in ordinary systems require another valve, the valve 12 supplying the pressure regulating function as well as on/off in response to valve 40.

SUMMARY OF OPERATION

As previously pointed out, the inlet line gas from the line 10 is utilized for operation of all of the valves through the pilot valves.

Line 470 leads from line 10 to the inlet of the booster pump 30 and to the area above the diaphragm 216 in the unit 34. The discharge from the booster 30 leads to the chamber below the diaphragm 216 in unit 34. At a predetermined pressure, for example, 6 pounds in line 474, the pressure below diaphragm 216 will move it and the part 220 upwardly, causing the opening of the reed switch 202 which is normally closed and thereby triggering the Triac 32 to the off position.

As pointed out in the sequencing operation, the valve 26 closes first; then valve 12 opens, and then valve 14 opens. Valve 12 will operate as an on/off valve and as a pressure regulator.

The circuit for the operation of valve 26 is as follows The pressure goes through line 475 from the discharge of unit 30 into the port 362 of the pilot valve mechanism 36. The valve 374' which is the bore 362, FIG. 2, which is now open, allows gas flow into the chamber 360. The flow is now out from the port 364, as mav be seen in FIG. 3. This port may be seen on FIG. 3, the flow being out into the line 482. Solenoid pilot valve 40 is now energized through the circuit 188–189, and the upper valve 244 is open; and gas flows through this valve from chamber 242, and it now flows out in line 484 to the chamber over the diaphragm in valve 12; and it flows through line 485 in parallel to the chamber over the diaphragm in valve 26 closing it. The pressure now starts to build over the diaphragm in valve 12, and it starts to open. Valve 26 closes quickly.

Line 486 now measures or senses the discharge pressure which is underneath the diaphragm 116 of valve 12, and this pressure is now lead through line 486 to the port 366' which is in communication with the chamber 354 in the body 320, that is, the chamber underneath the diaphragm 340. The bore 366 is in communication with the interior 354 of the body 320 by way of the channel 367 which may be seen in FIGS. 2 and 5. The valve of port 366 is closed at this time.

Figure 9:
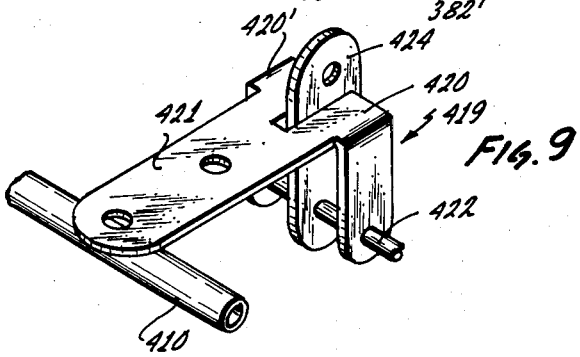
FIGS. 9 and 10 show details of the pilot valve actuator structure.
Figure 10:
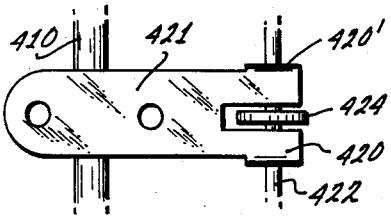
Figure 5:
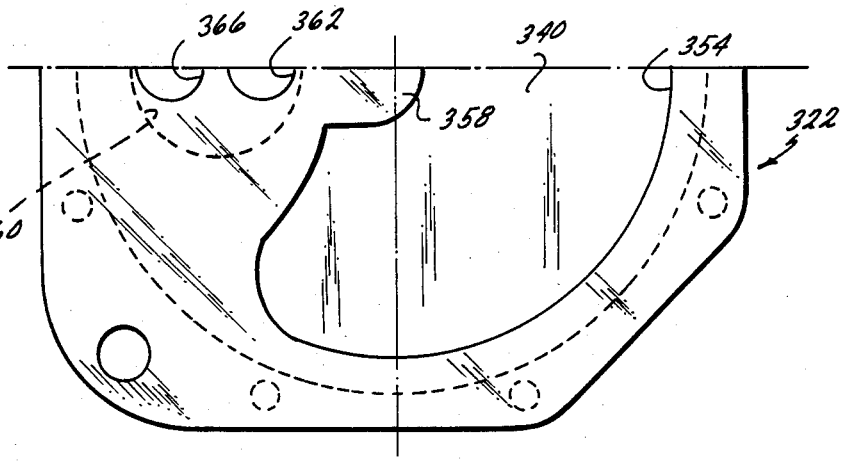
FIG. 5 is a bottom half view of the control valve of FIG. 2, that is, above part 363.

The pressure builds up under the diaphragm 340 until it balances the spring pressure of spring 341, and this now causes the valve actuator, as shown in detail in FIGS. 6, 9 and 10, to close valve 374' and open 374, that is, valve 374 will open if the pressure gets high enough.

When the pressure against the diaphragm 340 becomes balanced against the regulated pressure set by the spring acting on that diaphragm, the two pilot valves go to the closed position which is the neutral position, and that locks valve 12 in its position, that is, they go through that position. Following this action, valve 12 may be in only a very slightly open position.

The pressure continues to build up in the discharge side of the valve 12, and this pressure will be underneath the diaphragm 340; and when it gets high enough, it will cause pilot valve 374' to close and to open pilot 374, and this starts to close valve 12.

The pressure above the diaphragm 116 in valve 12 comes up through the line 484. It goes through the three-way valve 40 and then over to port 364 by way of line 482 into chamber 360, and then it goes through valve 374 to the chamber beneath the diaphragm 340. The chamber underneath the diapragm 340 is now connected through port 366' to the line 486. Pressure comes out of the chamber below the diaphragm 340 in pilot valve 36 through line 486 to the chamber below the diaphragm which connects to the discharge of valve 12. All of the foregoing operations take place in a fraction of a second. As can be seen, one of the pilot valves 374' involves opening of valve 12 and the other 374 closing.

Next will be traced the circuit for opening of valve No. 14.

There is enough pressure now in line 16 which passes through line 490 to act on unit 298 and to close the contacts 52–54 indicating that there is sufficient pressure available for operation. The valve 42 is now energized and moved to the open position in which the upper valve of the three-way valve is open and the lower closed.

The gas circuit for opening valve 14 is as follows.

It comes from the booster 30 through 374 and continues over to the volume or flow control device coming in through port 286 over the diaphragm 210. The flow is through orifice 269 causing the valve to operate as a constant flow device. The flow comes out of it through the channel 248' through the open valve of the three-way valve 42 and out of it through the line 480 to the chamber over the diaphragm 116' in valve 14.

In the event that valve 42 should become deenergized, it changes its position. Now the gas above the diaphragm in valve 14 would travel up through the line 480 to the common of three-way valve 42 and out through the lower valve of the three-way valve through line 478 to the chamber below the diaphragm 14 and out through the discharge, causing this valve to close. Thus, the valve 14 acts as a safety valve.

Three-way valve 40 is shown in a deenergized position, that is, the normal off position of the upper valve 244, and the valve 42 is shown in the deenergized position, which is normally the off position.

The two three-way valves are electrically operated valves that control the on and off of the system. When these two valves close, valves 12 and 14 will close in less than a second. If the three-way valve 42 is deenergized, it moves into a position, as shown in the drawing, wherein gas from above the diaphragm in valve 116' flows through the three-way valve 42 and out through line 478 to the discharge.

As may be seen, if the three-way valve 40 is deenergized, the pressure is released from over the diaphragm in valve 12, this pressure passing out through line 484 through the lower valve of valve unit 40 and through outlet 251 and line 486 to the chamber beneath the diaphragm 116 and to discharge.

From the foregoing, those skilled in the art will readily understand the nature and construction of the invention and its mode of operation. Also, it will be readily understood how the invention achieves all of the objects and advantages as set forth in the foregoing. Firstly, it is to be noted that the system uses no outside motive fluid for the controls but rather uses the incoming gas itself by way of having this pressure boosted. Nextly, the system automatically produces a desired and safe pressure-staged operation in which a valve 26 first closes, the valve 12 then opens, and finally 14 opens at a controlled rate consistent with safety.

What is claimed is:

1. In a gas fired control system including at least one pressure operated valve, pilot valve means for controlling said pressure operated valve, the pressure operated valve having a gas inlet, a branch line having a booster pump unit in it connected to said inlet for producing a boosted pressure above gas inlet pressure and means whereby said pilot valve means controls said pressure operated valve by controlling said booster pressure.

2. A system as in claim 1 including a second pressure operated valve and means whereby said second pressure operated valve is also controlled by way of booster pressure, controlled by said pilot valve means.

3. A system as in claim 2 having a vent line connected between the said pressure operated valves, a normally closed pressure operated vent valve in the vent line, the said pilot valve means including gas flow connections to the valves whereby the boosted pressure first operates to close the vent valve in a first stage, opens the first pressure operated valve in a second state, and opens the second pressure operated valve in a third stage.

4. A system as in claim 2 including a separate additional pilot valve connected for controlling boosted pressure to said second pressure operated valve, said separate additional pilot valve being constructed to provide a constant flow rate to said second pressure operated valve whereby to cause it to open at a controlled rate.

5. A system as in claim 4 including an electric pilot valve and flow control connections controlled by said electric pilot valve for causing said second pressure operated valve to close by releasing pressure above its diaphragm.

6. A system as in claim 1 including pressure operated means for controlling said booster pump unit, said pressure operated means including a reed type switch and a diaphragm means adjacent to it controlled by pressure generated by said booster pump unit.

7. A system as in claim 1 wherein said pressure operated valve is a diaphragm type valve having a diaphragm which has a pressure chamber over the diaphragm and a pressure chamber below the diaphragm, said pilot valve means having a valve controlling flow to the chamber above the diaphragm and a valve controlling release of pressure from above the diaphragm.

8. A system as in claim 7, said chamber below the diaphragm being in communication with the outlet of said pressure operated valve.

9. In a gas fired control system, at least one pressure operated gas valve having an outlet, the said pressure operated valve including a diaphragm for operating the valve having a pressure chamber above the diaphragm and a pressure chamber below the diaphragm, a source of control fluid for operating the said pressure operated valve, pilot valve means and control fluid lines whereby said pilot valve means controls the pressure above the diaphragm, said pilot valve means including a three-way valve having a first valve port controlling flow of pressure to the chamber above the diaphragm and a second valve port controlling release of pressure from the chamber above the diaphragm, said three-way valve having a null position in which both valve ports are closed said control fluid being the gas entering said pressure operated valve and a branch line having a booster pump in it for boosting pressure of incoming gas to enable it to be used as the said control fluid.

10. A system as in claim 9 wherein said pilot valve means includes a diaphragm chamber and a diaphragm, said three way valve actuatable by said last diaphragm, means providing communication between said first valve port and said source of control fluid, and means providing communication between the said second valve port and the chamber above the diaphragm and also with the outlet of the pressure operated valve.

11. A system as in claim 9 including an electric valve in a control line for gas to the chamber above the diaphragm, said electric valve including means operable to release the pressure above the diaphragm to the outlet of the pressure operated valve.

12. A system as in claim 9 including at least one additional pressure operated valve, said additional valve including a diaphragm and having a chamber above the said last diaphragm and a chamber below the said last diaphragm, an electric valve and control lines controlled by the electric valve for releasing pressure above the said last diaphragm.

13. A system as in claim 9 wherein the said pilot valve means includes means responsive to pressure in said chamber below the diaphragm to simultaneously control the first and second valve ports whereby to provide for communication of pressure to the said pressure chamber above the diaphragm in the pressure operated valve and to provide release of pressure to the pressure chamber below the diaphragm of the pressure operated valve to cause a balancing of pressures so that the pressure operated valve operates as a pressure regulator.

14. In a control system including at least one pressure operated valve, the pressure operated valve being a diaphragm type having a diaphragm and a pressure chamber above the diaphragm and below the diaphragm, the pressure operated valve having a fluid inlet, a branch line having a booster pump in it connected to said inlet for producing a boosted pressure above fluid inlet pressure, pilot valve means for controlling said pressure operated valve by controlling said boosted pressure, said pilot valve means including diaphragm means and first and second pilot valves, one of said pilot valves controlling boosted fluid pressure to the said pressure chamber above the diaphragm, the other of said pilot valves being connected to be operable to release pressure from the said pressure chamber above the diaphragm to the outlet of the pressure operated valve.

15. A control system as in claim 14 wherein the said diaphragm means for operating the said pilot valves is responsive to outlet pressure of the said pressure operated valve, the said diaphragm means being in a diaphragm chamber, said diaphragm means being connected to said pilot valves whereby to be operable to close the pilot valve controlling flow of boosted pressure to said pressure chamber above the diaphragm and to open the said other pilot valve whereby to provide communication between the said pressure chamber and the outlet of the pressure operated valve.

16. A system as in claim 15 wherein the said means for operating the said pilot valves is constructed whereby the said pilot valves have a null position wherein both are closed.

* * * * *